US011692416B2

(12) United States Patent
Noel

(10) Patent No.: US 11,692,416 B2
(45) Date of Patent: Jul. 4, 2023

(54) WEAR RESISTANT DOWNHOLE PISTON

(71) Applicant: Schlumberger Technology Corporation, Sugar Land, TX (US)

(72) Inventor: Anan Noel, Oklahoma City, OK (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 85 days.

(21) Appl. No.: 17/177,859

(22) Filed: Feb. 17, 2021

(65) Prior Publication Data

US 2021/0262290 A1 Aug. 26, 2021

Related U.S. Application Data

(60) Provisional application No. 62/979,533, filed on Feb. 21, 2020.

(51) Int. Cl.

| | |
|---|---|
| ***E21B 41/00*** | (2006.01) |
| ***E21B 10/25*** | (2006.01) |
| ***E21B 10/42*** | (2006.01) |
| *E21B 7/06* | (2006.01) |

(52) U.S. Cl.

CPC ..... *E21B 41/00* (2013.01); *E21B 10/25* (2013.01); *E21B 10/42* (2013.01); *E21B 7/065* (2013.01)

(58) Field of Classification Search

CPC . E21B 7/06; E21B 7/062; E21B 7/064; E21B 17/1014; E21B 17/1092

See application file for complete search history.

(56) References Cited

U.S. PATENT DOCUMENTS 2,743,781 A * 5/1956 Lane ..... E21B 23/01 166/212
2,959,225 A * 11/1960 Roberts ..... E21B 33/1243 166/147
3,989,554 A * 11/1976 Wisler ..... F16L 57/06 285/333
4,015,100 A * 3/1977 Gnanamuthu ..... B23K 26/32 219/76.1
4,194,031 A * 3/1980 Cullum ..... E21B 17/1085 219/76.1
4,690,229 A * 9/1987 Raney ..... E21B 10/43 175/408
4,781,770 A * 11/1988 Kar ..... B23K 35/30 148/903
5,511,627 A * 4/1996 Anderson ..... E21B 17/1014 175/325.2
5,535,838 A * 7/1996 Keshavan ..... E21B 10/46 175/374

(Continued)

*Primary Examiner* — Blake Michener

(57) ABSTRACT

A piston for use in a rotary steerable system includes a body formed from a first material. A sealing surface extends around the circumferential wall of the body. The sealing surface is formed from a plurality of layers of a second material. The second material is harder than the first material. The piston can be within a downhole piston assembly that also includes a housing, and the piston being longitudinally movable in a bore in the housing. A method for producing a piston includes preparing a piston formed from a first material, with the piston including a first end. A sealing surface is applied to the piston using laser cladding, with the sealing surface including a second material harder than the first material. The sealing surface is finished to a sealing surface diameter.

18 Claims, 11 Drawing Sheets

(56) References Cited

U.S. PATENT DOCUMENTS

| | | | | |
|---|---|---|---|---|
| 5,553,678 | A * | 9/1996 | Barr | E21B 47/022 175/324 |
| 5,819,862 | A * | 10/1998 | Matthias | E21B 10/567 175/428 |
| 9,085,941 | B2 | 7/2015 | Hall et al. | |
| 9,200,485 | B2 * | 12/2015 | Eason | C22C 29/08 |
| 10,632,713 | B2 | 4/2020 | Walker et al. | |
| 10,633,924 | B2 * | 4/2020 | Haugvaldstad | E21B 7/06 |
| 2008/0164070 | A1 * | 7/2008 | Keshavan | E21B 10/55 175/374 |
| 2010/0044026 | A1 * | 2/2010 | Head | E21B 43/128 166/105 |
| 2010/0307838 | A1 * | 12/2010 | Stevens | E21B 10/46 175/425 |
| 2013/0068449 | A1 * | 3/2013 | Pillai | C21D 9/00 420/104 |
| 2013/0206390 | A1 * | 8/2013 | Hall | E21B 17/1014 166/107 |
| 2015/0017394 | A1 * | 1/2015 | Johnson | B23K 26/342 428/192 |
| 2015/0132539 | A1 * | 5/2015 | Bailey | C23C 28/042 427/523 |
| 2015/0354290 | A1 * | 12/2015 | Lakkashetti | E21B 17/1014 175/56 |
| 2017/0081944 | A1 * | 3/2017 | Wang | C22C 38/32 |
| 2018/0202233 | A1 * | 7/2018 | Cleboski | E21B 17/1092 |
| 2018/0223435 | A1 * | 8/2018 | Johnson | B23K 26/1476 |
| 2020/0332607 | A1 * | 10/2020 | Panda | C23C 24/103 |

* cited by examiner

WEAR RESISTANT DOWNHOLE PISTON

CROSS-REFERENCE TO RELATED APPLICATIONS

This application claims the benefit of, and priority to, U.S. Patent Application No. 62/979,533, filed Feb. 21, 2020, which application is expressly incorporated herein by this reference in its entirety.

BACKGROUND

Rotary steerable systems ("RSS") can include pistons that extend to engage with a wellbore wall. Contact with the piston and the wellbore wall may help to change the trajectory of a bit. The pistons may extend and retract through hundreds of thousands or millions of cycles during a single drilling run. This may cause wear on the sealing surfaces of the pistons.

SUMMARY

In some embodiments, a piston for use in a downhole valve includes a body formed of a first material. The body includes a first end, a second end, and a circumferential wall. A sealing surface may extend around the circumferential wall. The sealing surface is formed by laser cladding a second material to the body and is harder than the first material. In some embodiments, the piston may be longitudinally movable in a housing bore. The sealing surface may form a seal with the inner surface of the bore between the first end and the second end of the body.

In some embodiments, a method for manufacturing a piston includes preparing a piston having a first end. The piston is formed from a first material. A sealing surface is applied to the piston via laser cladding. The sealing surface includes a second material that is harder than the first material. The sealing surface is finished to a sealing surface diameter.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 1-1 is a representation of a bit and rotary steerable system, according to at least one embodiment of the present disclosure;

FIG. 3-1 and FIG. 3-2 are representations of another piston, according to at least one embodiment of the present disclosure;

FIG. 8-1 is a representation of a piston assembly in the retracted position, according to at least one embodiment of the present disclosure;

FIG. 8-2 is a representation of the piston assembly of FIG. 8-1 in the extended position.

DETAILED DESCRIPTION

This disclosure generally relates to devices, systems, and methods for wear resistant pistons for use in downhole drilling operations. Downhole pistons include one or more wear and/or sealing surfaces. The sealing surface engages the inner surface of a housing, and may form a tolerance seal with the inner surface. During operation, the sealing surface may experience wear, which may cause the seal to lose integrity and may cause the piston to lose efficiency and/or break. According to embodiments of the present disclosure, a piston may include a sealing surface made from a hard material applied using laser cladding. This sealing surface may have a strong bond to the sealing surface. Furthermore, the sealing surface may not experience any wear over hundreds of thousands of piston cycles, or may experience reduced wear such that the operational lifetime of the piston is increased.

Figure 1:
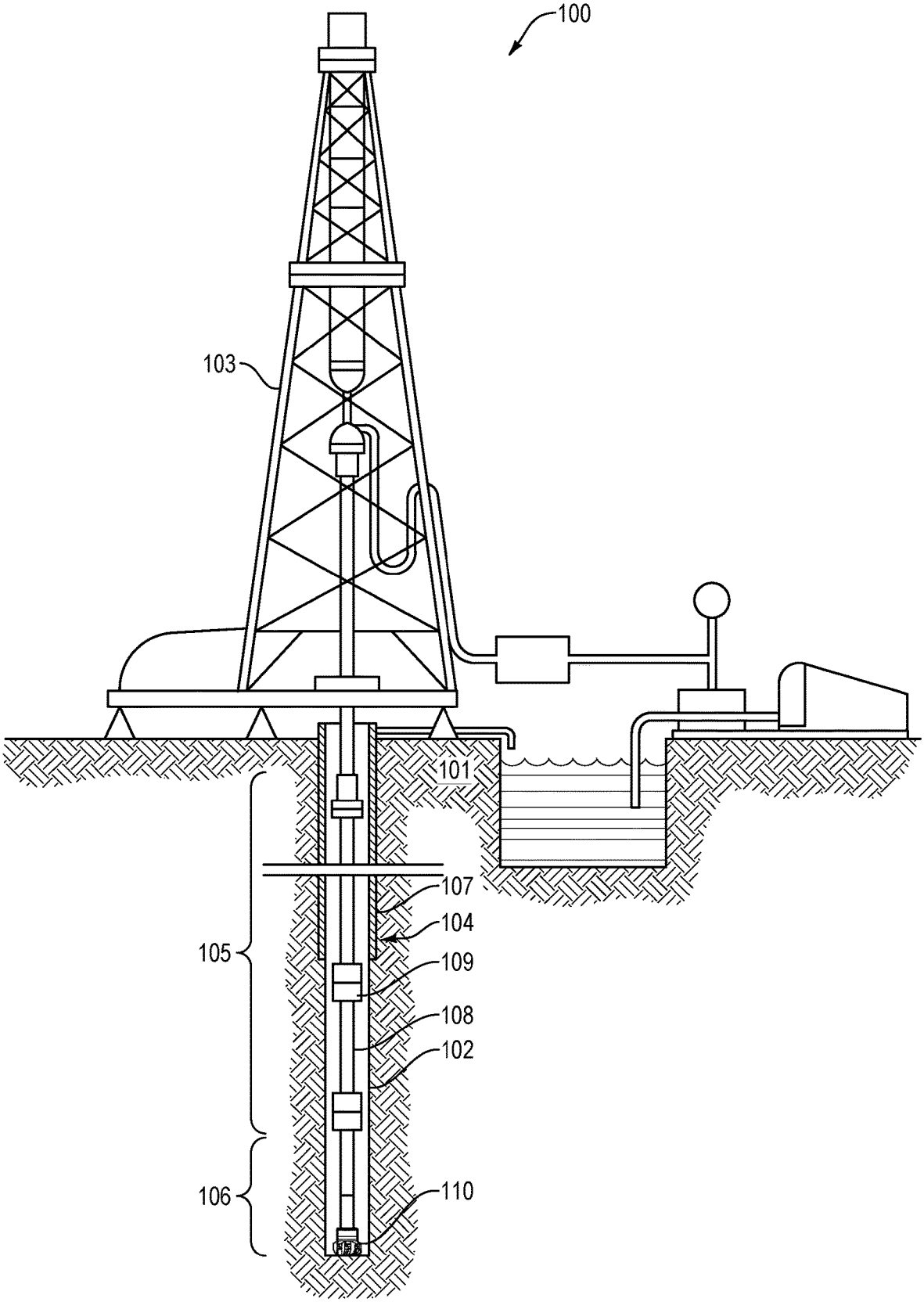
FIG. 1 is a representation of a drilling system, according to at least one embodiment of the present disclosure.
Figure 1:
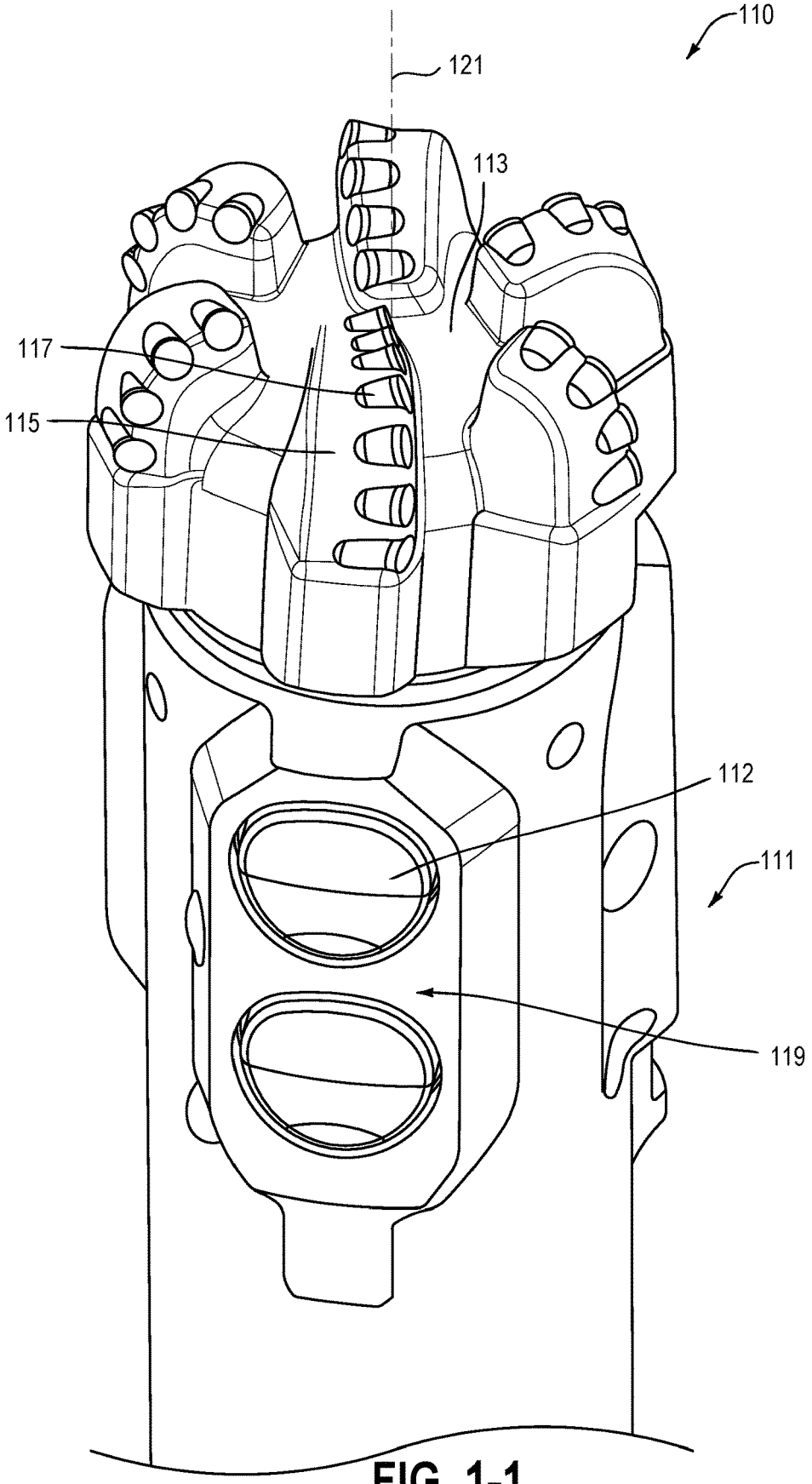

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include an RSS. The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

FIG. 1-1 is a perspective view of the downhole end of an embodiment of a bit 110 and connected RSS 111. The bit 110 may include a bit body 113 from which a plurality of blades 115 may protrude. At least one of the blades 115 may have a plurality of cutting elements 117 connected thereto. In some embodiments, at least one of the cutting elements may be a planar cutting element, such as a shear cutting element. In other embodiments, at least one of the cutting elements may be a non-planar cutting element, such as a conical cutting element or a ridged cutting element.

The RSS 111 may include one or more steering devices 119. In some embodiments, the steering device 119 may include one or more pistons 112 that are actuatable to move in a radial direction from a longitudinal axis 121 of the bit 110 and RSS 111. In other embodiments, the steering device 119 may be or include an actuatable surface or ramp that moves in a radial direction from the longitudinal axis 121. The bit 110 and RSS 111 may rotate about the longitudinal axis 121, and the one or more steering devices 119 may actuate in a timed manner with the rotation to urge the bit 110 in direction perpendicular to the longitudinal axis 121.

Figure 2:
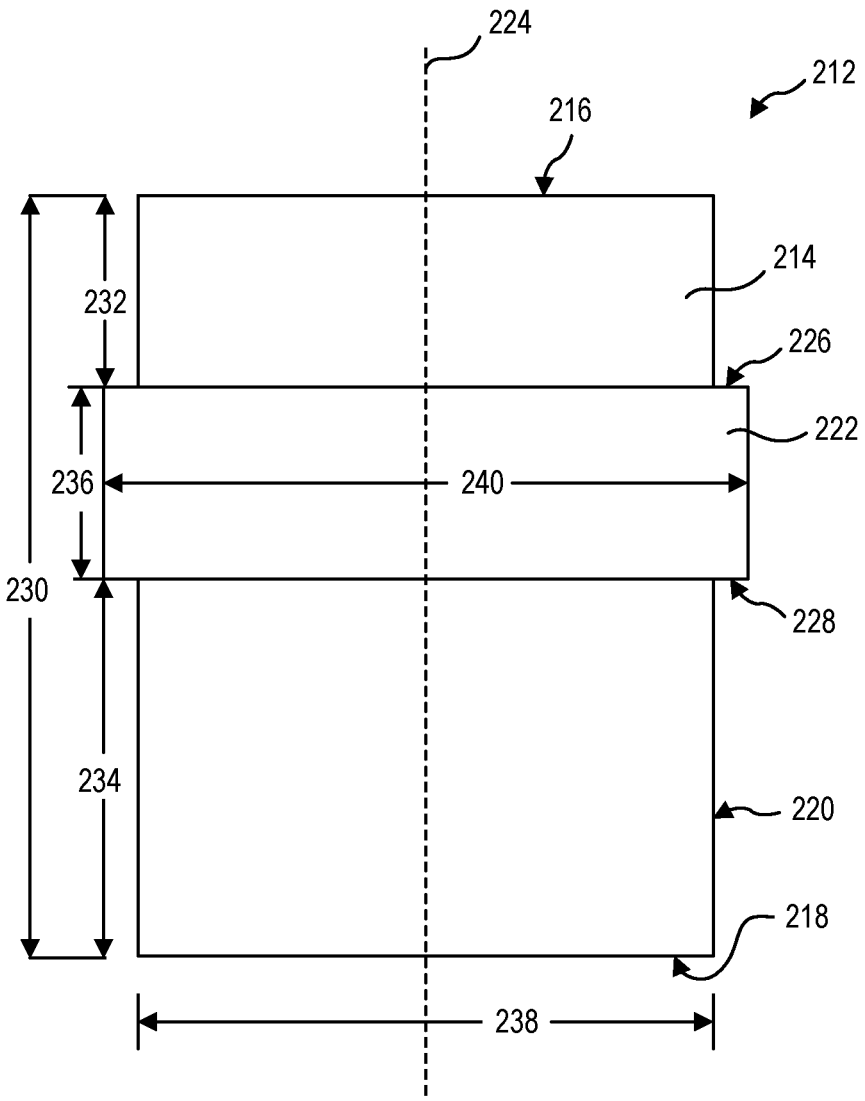
FIG. 2 is a representation of a piston, according to at least one embodiment of the present disclosure.

FIG. 2 is a representation of a piston 212 for a downhole drilling system (such as the piston 112 shown in FIG. 1-1), according to at least one embodiment of the present disclosure. The piston 212 may be any piston used in a downhole drilling system. For example, the piston 212 may be the steering pad of a directional drilling system such as an RSS, or a steering pad of another tool. In some examples, the piston 212 may be the piston in an expandable stabilizer or other expandable tool.

The piston 212 includes a body 214. The body 214 includes a first end 216, a second end 218, and a circumferential wall 220. In some embodiments, the piston 212 may be configured to extend in a longitudinal direction along the longitudinal axis 224 (e.g., the extension axis). For example, the first end 216 may be a contact surface, and be configured to contact a wellbore wall. The piston 212 may extend such that the first end 216 moves away from a housing along the longitudinal axis 224 toward the wellbore wall. When the first end 216 contacts the wellbore wall, the first end 216 may push against the wellbore wall, thereby causing a bit to change direction and/or inclination.

In some embodiments, the body 214 may be cylindrical. Thus, the transverse cross-sectional shape of the body 214 may be circular. In some embodiments, the body 214 may have a transverse cross-sectional shape that is any shape, including elliptical, triangular (3-sided), square (4-sided), pentagonal (5-sided), hexagonal (6-sided), heptagonal (7-sided), octagonal (8-sided), 9-sided, 10-sided, polygonal of any number sides, irregularly shaped, or any other shape.

The circumferential wall 220 may extend around an entirety of the body 214 between the first end 216 and the second end 218. Thus, regardless of the number of sides that the transverse cross-sectional shape includes, the circumferential wall 220 may extend around the perimeter of the body between the first end 216 and the second end 218.

The piston 212 shown includes a sealing surface 222. The sealing surface 222 may extend around the circumferential wall 220. In other words, the sealing surface 222 may extend around the perimeter of the body 214 between the first end 216 and the second end 218. The sealing surface 222 may be applied to the body 214 via laser cladding. In other words, the sealing surface 222 is formed by laser cladding a sealing surface material to the body 214. Connecting the sealing surface 222 to the body 214 may provide a stronger connection between the sealing surface 222 and the body 214, which may extend the life of the sealing surface and/or allow for different materials to be used for the sealing surface 222.

The body 214 may be formed from a body material (e.g., a first material). The sealing surface 222 may be formed from a sealing surface material (e.g., a second material). In some embodiments, the body material may be different from the sealing surface material. The body material may be different from the sealing surface material in one or more material properties. For example, the body material may be different from the sealing surface material in at least one of chemical composition, particle size, particle hardness, particle density, particle shape, particle size ratio, binder material, any other material property, and combinations thereof. In some embodiments, both the body material and the sealing surface material may include tungsten carbide particles. However, the body material may be different from the sealing surface material because the body material may include a different binder, different particle size, different particle size distribution, additional non-tungsten carbide particles, or other material property differences. In some embodiments, the sealing surface material may be different from the body material in any physical or chemical property.

In some embodiments, the body material may be any material, including infiltrated tungsten carbide, steel alloys, nickel alloys, any other material, or combinations thereof. In some embodiments, the sealing surface material may be any material, including sintered tungsten carbide, nickel chromium alloys, hardened steel, or combinations thereof. In some embodiments, the sealing surface material may be a TECHNOLASE® powder from TECHNOGENIA®. For example, the sealing surface material may be TECHNOLASE® 40S, TECHNOLASE® 20S, TECHNOLASE®

30S, TECHNOLASE® 50S, TECHNOLASE® 60S, or any other powder or material from TECHNOGENIA®.

In some embodiments, the sealing surface material may be harder than the body material. For example, the sealing surface material may have a hardness that is greater than 20 HRC, greater than 25 HRC, greater than 30 HRC, greater than 35 HRC, greater than 40 HRC, greater than 45 HRC, or greater than 50 HRC. In some embodiments, it is critical that the sealing surface material has a hardness of greater than 40 HRC to prevent wear of the sealing surface during operation.

Conventionally, a layer of hardfacing may be connected to the body 214 via braze, weld, mechanical connector, other connection mechanism, or combinations thereof. However, these connections may result in the hardfacing flaking, chipping, or otherwise removing from the body. This may result in reduced performance of the piston and/or cause damage to the piston or other downhole components. In contrast, in some embodiments, the sealing surface material may form a plurality of layers rather than a single layer of hardfacing via braze, weld, etc.

In some embodiments, laser cladding of the sealing surface 222 to the body 214 may provide a stronger bond between the sealing surface material and the body material than conventional connection mechanisms. In some embodiments, laser cladding may occur at a higher temperature that conventional connection mechanisms. This may result in the sealing surface material bonding to the hard particles of the body material and the binder, rather than only the binder. Thus, in some embodiments, laser cladding of the sealing surface 222 to the body 214 may result in the sealing surface material bonding directly to tungsten carbide particles in the body 214, which may result in a strong bond between the sealing surface 222 and the body 214, thereby reducing the flaking and/or chipping of the sealing surface 222 from the body 214, which may extend the operational life of the piston 212.

In some embodiments, the sealing surface 222 may extend around the circumferential wall 220 such that the sealing surface 222 is perpendicular to the longitudinal axis 224 (e.g., the longest axis, the extension axis). In this manner, the sealing surface 222 may be configured to engage the inner surface of a housing. In some embodiments, the sealing surface 222 may be configured to form a tolerance seal between the inner surface of the housing and the sealing surface 222 (e.g., a seal based on a small gap between the inner surface of the housing and the sealing surface 222). By forming the sealing surface 222 from a hard material (e.g., with a hardness of greater than 40 HRC), the sealing surface 222 may experience reduced wear over repeated (e.g., over 100,000) cycles of extension and retraction in the housing. This may increase the operational life and/or the efficiency of the piston 212.

In some embodiments, the sealing surface 222 may be circumferentially continuous. In other words, the sealing surface 222 may extend around an entirety of the circumferential wall 220 such that there are no gaps around the circumference of the sealing surface 222. This may help the sealing surface 222 to form a seal with a housing.

In some embodiments, the sealing surface 222 may be longitudinally offset from the first end 216 and/or the second end 218. For example, the sealing surface 222 includes an outer edge 226 and an inner edge 228. The piston 212 has a piston length 230 from the first end 216 to the second end. In some embodiments, the outer edge 226 of the sealing surface 222 is located (e.g., longitudinally offset) an outer edge distance 232 from the first end 216. In some embodiments, the outer edge distance 232 may be zero. In other words, the outer edge 226 may be located at the first end 216. Thus, the sealing surface 222 may extend to the first end 216, or be flush with the first end 216.

In some embodiments, the outer edge distance 232 may be an outer edge percentage of the piston length 230 (e.g., the outer edge distance 232 divided by the piston length 230). In some embodiments, the outer edge percentage may be in a range having a lower value, an upper value, or lower and upper values including any of 1%, 5%, 10%, 20%, 25%, 30%, 40%, 50%, 60%, 70%, 80%, 90%, or any value therebetween. For example, the outer edge percentage may be greater than 1%. In another example, the outer edge percentage may be less than 90%. In yet other examples, the outer edge percentage may be any value in a range between 1% and 90%. In some embodiments, it may be critical that the outer edge percentage is greater than 10% to allow the sealing surface 222 to engage the housing in the retracted position and thereby prevent waste.

In some embodiments, the inner edge 228 may be located (e.g., longitudinally offset) an inner edge distance 234 from the second end 218. In some embodiments, the inner edge distance 234 may be zero. In other words, the inner edge 228 may be located at the second end 218. Thus, the sealing surface 222 may extend to the second end 218, or be flush with the second end 218.

In some embodiments, the inner edge distance 234 may be an inner edge percentage of the piston length 230 (e.g., the inner edge distance 234 divided by the piston length 230). In some embodiments, the inner edge percentage may be in a range having a lower value, an upper value, or lower and upper values including any of 1%, 5%, 10%, 20%, 25%, 30%, 40%, 50%, 60%, 70%, 80%, 90%, or any value therebetween. For example, the inner edge percentage may be greater than 1%. In another example, the inner edge percentage may be less than 90%. In yet other examples, the inner edge percentage may be any value in a range between 1% and 90%. In some embodiments, it may be critical that the inner edge percentage is less than 30% to support the body 214 of the piston 212 when the piston 212 is in the extended position.

The sealing surface 222 includes a sealing surface length 236, which may be the distance between the outer edge 226 and the inner edge 228. The sealing surface length 236 may be a sealing percentage of the piston length 230 (e.g., the sealing surface length 236 divided by the piston length 230). In some embodiments, the sealing percentage may be in a range having a lower value, an upper value, or lower and upper values including any of 5%, 10%, 15%, 20%, 25%, 30%, 40%, 50%, 60%, 70%, 75%, 80%, 85%, 90%, 95%, or any value therebetween. For example, the sealing percentage may be greater than 5%. In another example, the sealing percentage may be less than 95%. In yet other examples, the sealing percentage may be any value in a range between 5% and 95%. In some embodiments, it may be critical that the sealing percentage is greater than 30% to provide a seal with the inner surface of the housing.

The body 214 of the piston 212 has a body diameter 238. The sealing surface 222 has a sealing surface diameter 240. In some embodiments, the sealing surface diameter 240 may be larger than the body diameter 238. In other words, the sealing surface 222 may be applied to an outside of the body 214. In some embodiments, the sealing surface 222 has a diameter percentage (e.g., the sealing surface diameter 240 divided by the body diameter 238) that is greater than 100%. In some embodiments, the diameter percentage may be in a range having a lower value, an upper value, or lower and upper values including any of 101%, 102%, 103%, 104%, 105%, 106%, 107%, 108%, 109%, 110%, or any value therebetween. For example, the diameter percentage may be greater than 101%. In another example, the diameter percentage may be less than 110%. In yet other examples, the diameter percentage may be any value in a range between 101% and 110%. In some embodiments, the sealing surface diameter 240 may be equal to the body diameter 238.

Figures 1, 3:
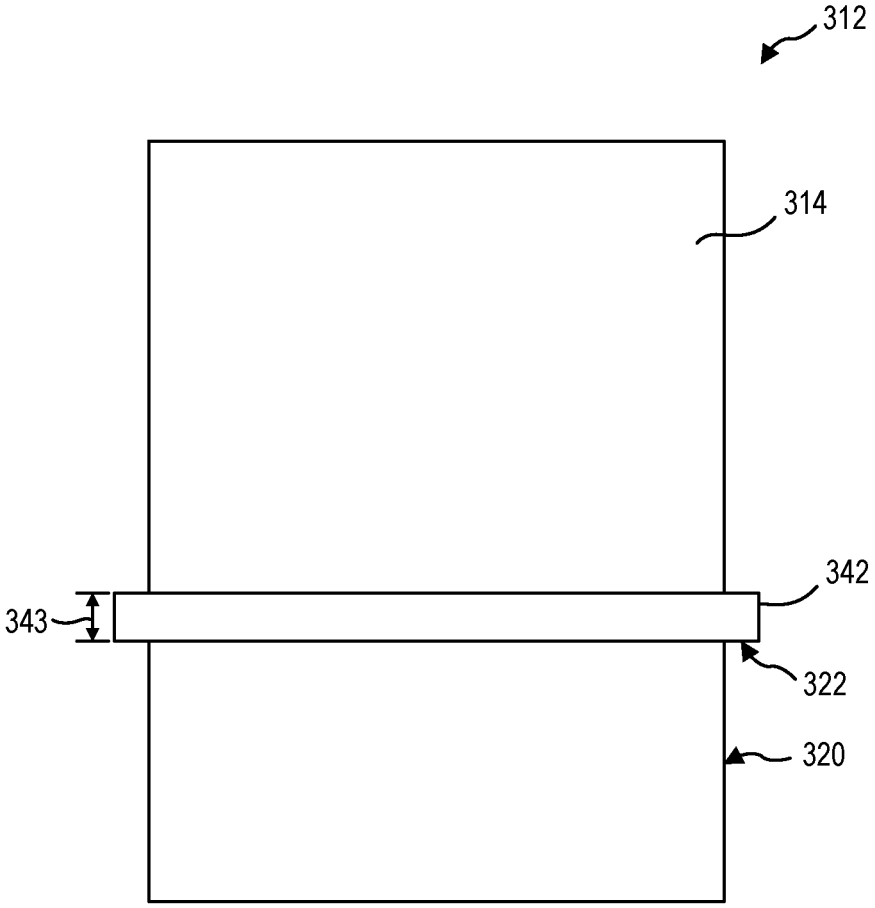
Figures 2, 3:
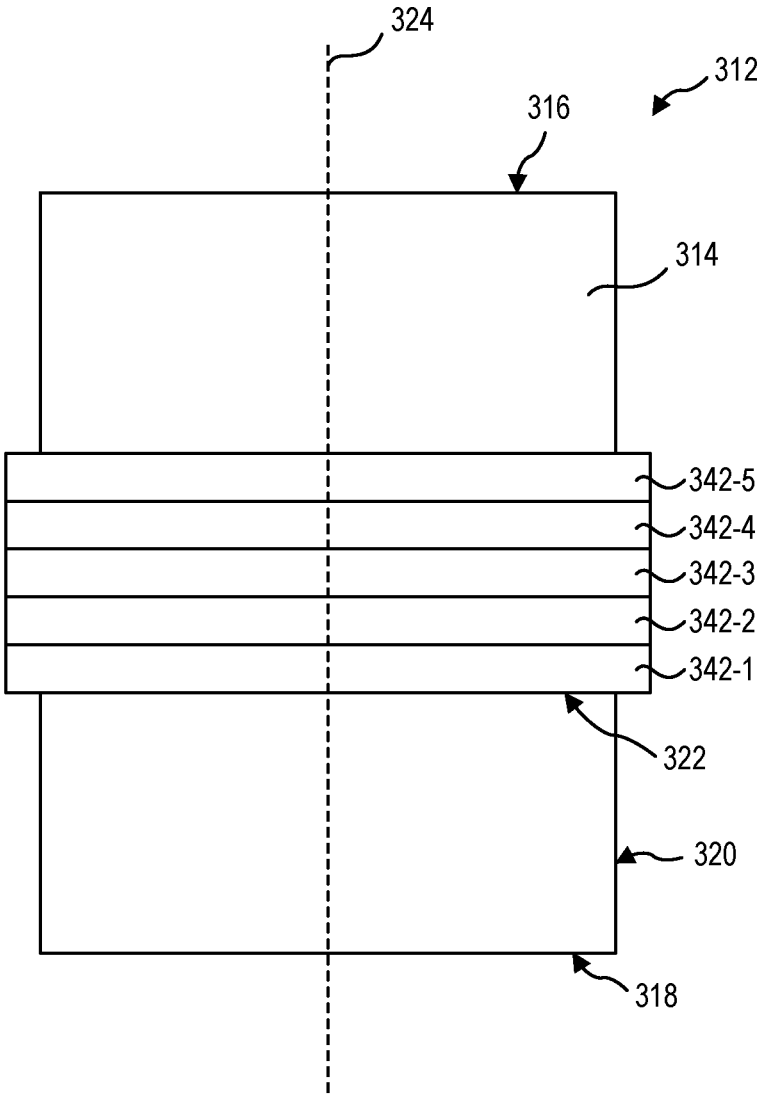

FIG. 3-1 is a representation of a piston 312, according to at least one embodiment of the present disclosure. In some embodiments, the sealing surface 322 may be applied to the body 314 with one or more layers 342. The circumferential wall 320 of the body 314 may be prepared prior to deposition of the layers 342. For example, the circumferential wall 320 of the body 314 may be machined (e.g., ground) to a preparation diameter. A powder containing the sealing surface material may be directed to the circumferential wall and a laser may bind the powder to the body 314 as the sealing surface 322.

The one or more layers 342 have a layer thickness 343. In some embodiments, the layer thickness 343 may be in a range having a lower value, an upper value, or lower and upper values including any of 1.0 mm, 1.5 mm, 2.0 mm, 2.5 mm, 3.0 mm, 3.5 mm, 4.0 mm, 4.5 mm, 5.0 mm, 6 mm, 7 mm, 8 mm, 9 mm, 10 mm, or any value therebetween. For example, the layer thickness 343 may be greater than 1.0 mm. In another example, the layer thickness 343 may be less than 10.0 mm. In yet other examples, the layer thickness 343 may be any value in a range between 1.0 mm and 10.0 mm.

In the view shown in FIG. 3-1, a single layer 342 of the sealing surface 322 has been applied to the body 314. In some embodiments, the single layer 342 may be the beginning of a plurality of layers 342 which may form the sealing surface 322. In some embodiments, the single layer 342 may form the entirety of the sealing surface 322. FIG. 3-2 is a representation of the piston 312 of FIG. 3-1 that includes a sealing surface 322 that is formed from a plurality of layers (collectively 342). In some embodiments, each layer 342 of the plurality of layers 342 is formed from the same material. In some embodiments, different layers 342 may be formed from different materials.

In some embodiments, the layers 342 may be formed longitudinally. In other words, the layers 342 may each form a ring around the circumferential wall 320. Subsequent layers 342 may be formed longitudinally along the circumferential wall 320. For example, a first layer 342-1 may initially be deposited on the body 314. A second layer 342-2 may be deposited on the body 314 longitudinally offset from the first layer 342-1 such that the second layer 342-2 is longitudinally adjacent the first layer 342-1 on the side of the first end 316. A third layer 342-3, fourth layer 342-4, fifth layer 342-5, and a plurality of other layers 342 may be deposited longitudinally adjacent the subsequent layers 342. In this manner, the sealing surface 322 may form a solid surface perpendicular to the longitudinal axis 324. It should be understood that subsequent adjacent layers 342 may be formed in the direction of the second end 318.

In the embodiment shown in FIG. 3-1 and FIG. 3-2, the layers 342 are shown as continuous, distinct, and individual rings around the circumferential wall of the body 314. However, it should be understood that the sealing surface 322 may be formed using any layer type geometry. For example, the sealing surface 322 may be formed from a single continuous spiral (e.g., helical) that circles the body 314 one or more times to form the sealing surface 322. In some examples, the sealing surface 322 may be formed from a plurality of longitudinal layers that extend along the body 314 parallel to the longitudinal axis 324, with each layer being arranged circumferentially adjacent to the other layers. In this manner, the layers may resemble strips of the sealing surface material that extend between the first end 316 and the second end 318.

Figure 4:
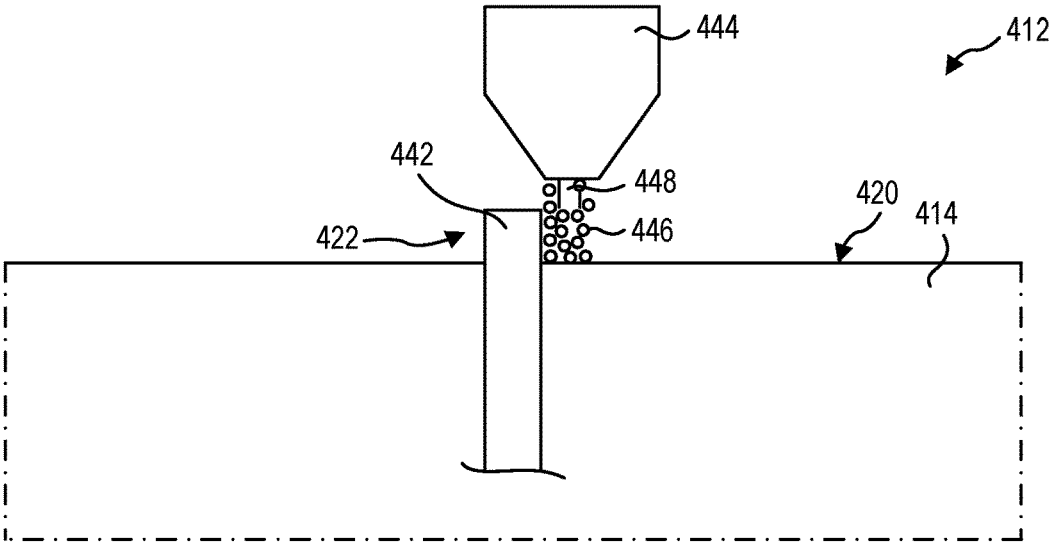
FIG. 4 is a representation of a piston receiving laser cladding, according to at least one embodiment of the present disclosure.

FIG. 4 is a representation of close-up view of a piston 412 that is having a sealing surface 422 deposited on the circumferential wall 420 of a body 414, according to at least one embodiment of the present disclosure. In the embodiment shown, a first layer 442 has been deposited, and a second layer is in the process of being deposited on the body 414. A nozzle 444 may be directed over the circumferential wall 420. The nozzle 444 may receive material powder 446 from a powder source (e.g., a powder feeder that directs powder to the nozzle). The nozzle 444 may direct the material powder 446 at the circumferential wall 420 adjacent to the first layer 442.

The nozzle may further direct a laser beam 448 (from a laser, such as a diode laser) at the material powder 446. The laser beam 448 may heat the material powder 446 and/or the body material of the body 414 at the circumferential wall 420. This may cause the material powder 446 to bond to the circumferential wall 420. For example, bonding of the material powder 446 may occur by partially or fully melting the material powder 446 and/or a portion of the body 414 at the circumferential wall 420. The materials of the partially or fully melted material powder 446 and body 414 may adhere (e.g., mix, sinter), and, when solidified, the material powder 446 may be bonded to the body 414 as a layer 442 of the sealing surface 422. In some embodiments, at least a portion of the material powder 446 may adhere to at least a portion of the first layer 442.

In some embodiments, the body 414 of the piston 412 may be connected to a multi-axis controller, which may cause the body 414 to move relative to the nozzle 444. For example, the body 414 may be rotated about the longitudinal axis (e.g., longitudinal axis 224 of FIG. 2) relative to the nozzle 444. In some embodiments, the body 414 may be moved longitudinally relative to the nozzle 444 (e.g., parallel to the longitudinal axis 224 toward the first end 216 or the second end 218 of FIG. 2). In some embodiments, the body 414 may be moved longitudinally and rotated relative to the nozzle 444. In some embodiments, the body 414 may be moved in any direction relative to the nozzle 444, including perpendicular to the longitudinal axis, rotated transverse to the longitudinal axis, any other direction, and combinations thereof. Thus, as the nozzle 444 continuously deposits material powder 446 and directs the laser beam 448 at the material powder 446, a new layer may be formed adjacent to the first layer 442. In some embodiments, the nozzle 444 may move relative to the body 414 to deposit the layer. For example, the nozzle 444 may be rotated, moved longitudinally, moved radially, otherwise moved or rotated, or combinations thereof, relative to the body 414.

Figure 5:
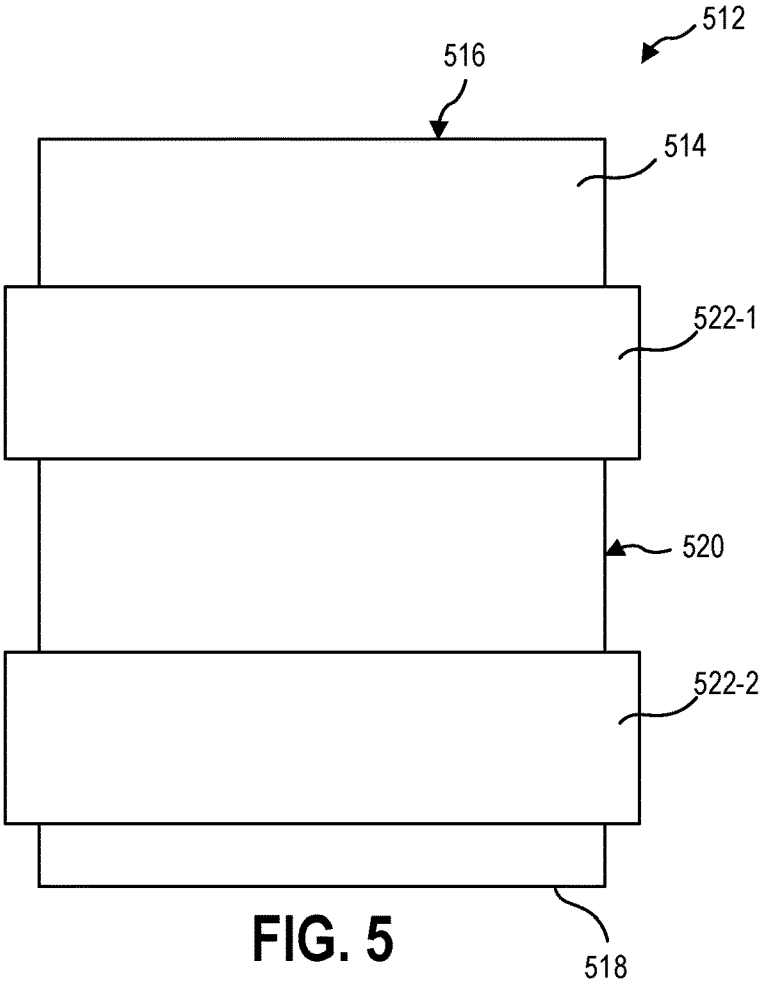
FIG. 5 is a representation of yet another piston, according to at least one embodiment of the present disclosure.

FIG. 5 is a representation of a piston 512 including a plurality of sealing surfaces (collectively 522), according to at least one embodiment of the present disclosure. In the embodiment shown, the piston 512 includes a first sealing surface 522-1 and a second sealing surface 522-2. The first sealing surface 522-1 may be located on the body 514 closer to the first end 516 than the second sealing surface 522-2. Similarly, the second sealing surface 522-2 may be located on the body closer to the second end 518 than the first sealing surface 522-1. In the embodiment shown, the first sealing surface 522-1 is longitudinally offset from the second sealing surface 522-2. Accordingly, the first sealing surface 522-1 is separate and distinct from the second sealing surface 522-2. The first sealing surface 522-1 may be separated from the second sealing surface 522-2 by at least a portion of the circumferential wall 520 of the body 514.

Two sealing surfaces 522 may increase the stability of the piston 512 during actuation. This may help to prevent tilting or other lateral movement of the piston 512 relative to a housing during operation. Preventing tilting and other lateral movement may help prevent binding (e.g., getting stuck) of the piston 512 in the housing. This may improve the reliability of the piston 512 and/or extend the operating life of the piston 512. Furthermore, while the same stability benefit may be provided by a continuous sealing surface 522 (e.g., continuous between the first sealing surface 522-1 and the second sealing surface 522-2), including two sealing surfaces may provide stability while reducing the amount of sealing surface material used, thereby reducing manufacturing costs.

In some embodiments, one or both of the sealing surfaces 522 may be circumferentially continuous. A circumferentially continuous sealing surface 522 may not include any gaps around the circumference of the body 514. In some embodiments, the second sealing surface 522-2 may be circumferentially continuous, and the first sealing surface 522-1 may not be circumferentially continuous. For example, the first sealing surface 522-1 may include gaps. This may help to reduce the amount of sealing surface material used, which may help to reduce manufacturing costs. In this manner, the second sealing surface 522-2 may provide a seal for the piston 512, and the first sealing surface 522-1 may help to guide and support the piston 512 during actuation. In some embodiments, the first sealing surface 522-1 may be circumferentially continuous and the second sealing surface 522-2 may not be circumferentially continuous.

Figure 6:
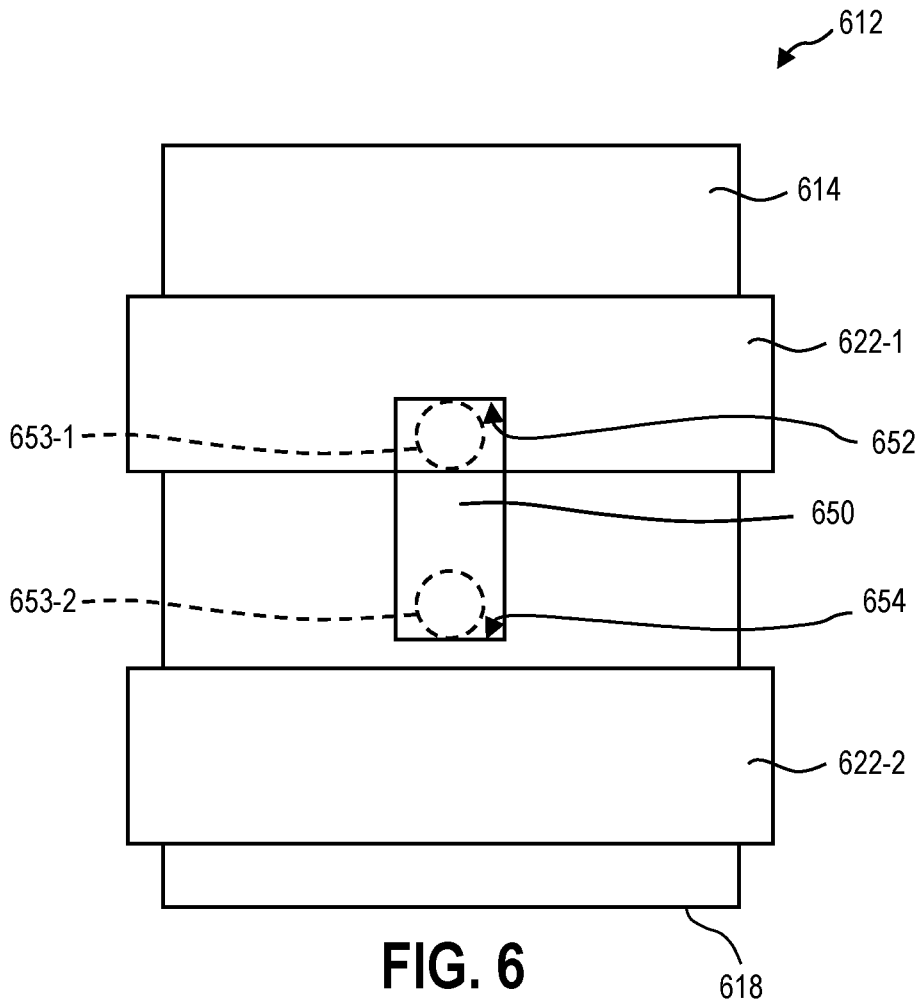
FIG. 6 is a representation of still another piston, according to at least one embodiment of the present disclosure.

FIG. 6 is a representation of a piston 612 including a piston bore 650. The piston bore 650 may extend through the body 614 of the piston 612. The piston bore 650 may be configured to receive a pin from a housing. The pin may extend into the piston bore 650. During retraction (e.g., in the retracted position), the pin (shown schematically in dashed lines at position 653-1) may contact a bore first end 652. This may help to retain the piston 612 in the retracted position and prevent the piston 612 from over-retracting. During extension (e.g., in the extended position), the pin (shown schematically in dashed lines at position 653-2) may contact a bore second end 654. This may help to retain the piston 612 in the extended position and prevent the piston 612 from over-extending.

The piston 612 shown includes a first sealing surface 622-1 and a second sealing surface 622-2. The first sealing surface 622-1 may be located at or near the bore first end 652. The second sealing surface 622-2 may be located at or near the bore second end 654. In some embodiments, the first sealing surface 622-1 may longitudinally extend past the bore first end 652. In some embodiments, the first sealing surface 622-1 may be offset from the bore first end 652. In some embodiments, the second sealing surface 622-2 may longitudinally extend past the bore second end 654. In some embodiments, the second sealing surface 622-2 may be offset from the bore second end 654.

As discussed above, one or both of the first sealing surface 622-1 and the second sealing surface 622-2 may be circumferentially continuous. A circumferentially continuous second sealing surface 622-2 may help to seal the piston bore 650 from drilling and/or actuation fluid that acts on the second end 618 to extend the piston 612. This may help to reduce damage to the piston 612 at the piston bore 650 and/or reduce damage to the pin that extends into the piston bore. In some embodiments, a circumferentially continuous first sealing surface 622-1 may help to seal the piston bore 650 from cuttings and/or drilling fluid that may travel into the piston bore 650 during drilling and/or steering operations. This may help to reduce wear on the piston bore 650 and/or the pin extending into the piston bore 650, thereby increasing the operational lifetime of the piston 612.

Figure 7:
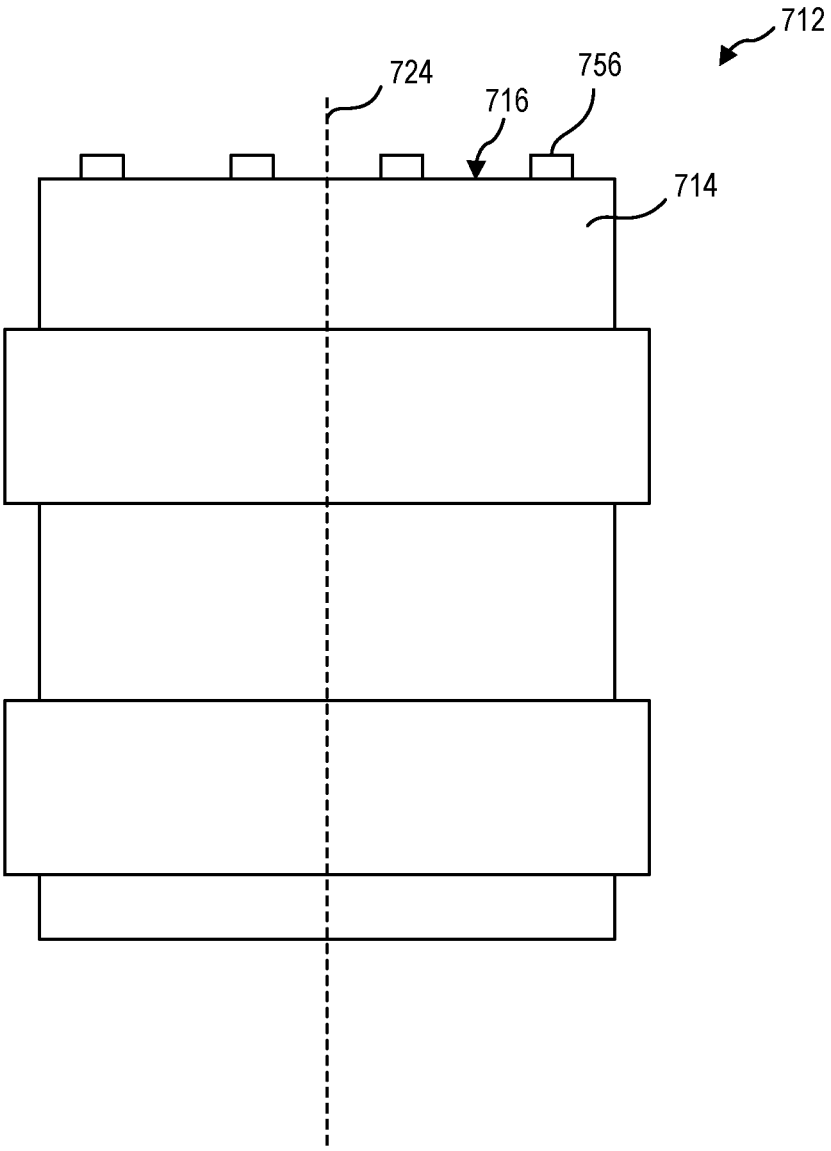
FIG. 7 is a representation of a further piston, according to at least one embodiment of the present disclosure.

FIG. 7 is a representation of a piston 712 including wear surfaces 756 on the first end 716, according to at least one embodiment of the present disclosure. In some embodiments, the piston 712 may extend along the longitudinal axis 724 (e.g., the extension axis) such that the first end 716 moves out of a housing. The first end 716 may engage a wellbore wall and impart a force against the wellbore wall to change a trajectory of the bit. In some embodiments, the first end 716 may include one or more wear surfaces 756. The wear surfaces 756 may be formed from a wear and/or erosion resistant material to reduce wear when contacting the wellbore wall. In some embodiments, the wear surfaces 756 may be formed by laser cladding, as discussed herein, especially with reference to FIG. 3-1 through FIG. 4, and the associated description. In this manner, the wear surfaces 756 may be formed with a hard material that has a high bonding strength to the body 714. In some embodiments, the first end 716 may be planar. In some embodiments, the first end 716 may be contoured or otherwise have a shape that is not planar. For example, the first end 716 may include a convex shape that is configured to match the profile of the wellbore wall.

Figures 1, 8:
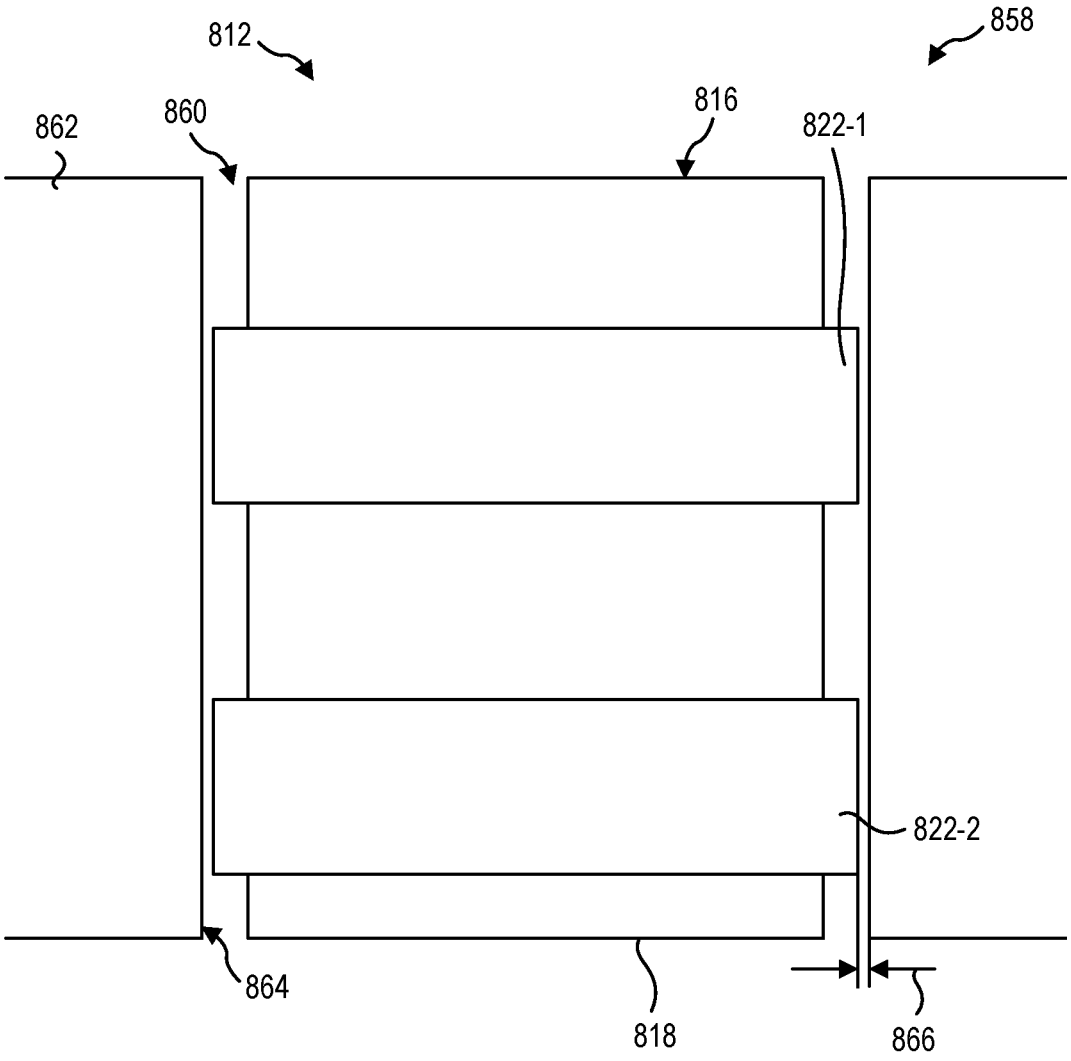
Figures 2, 8:
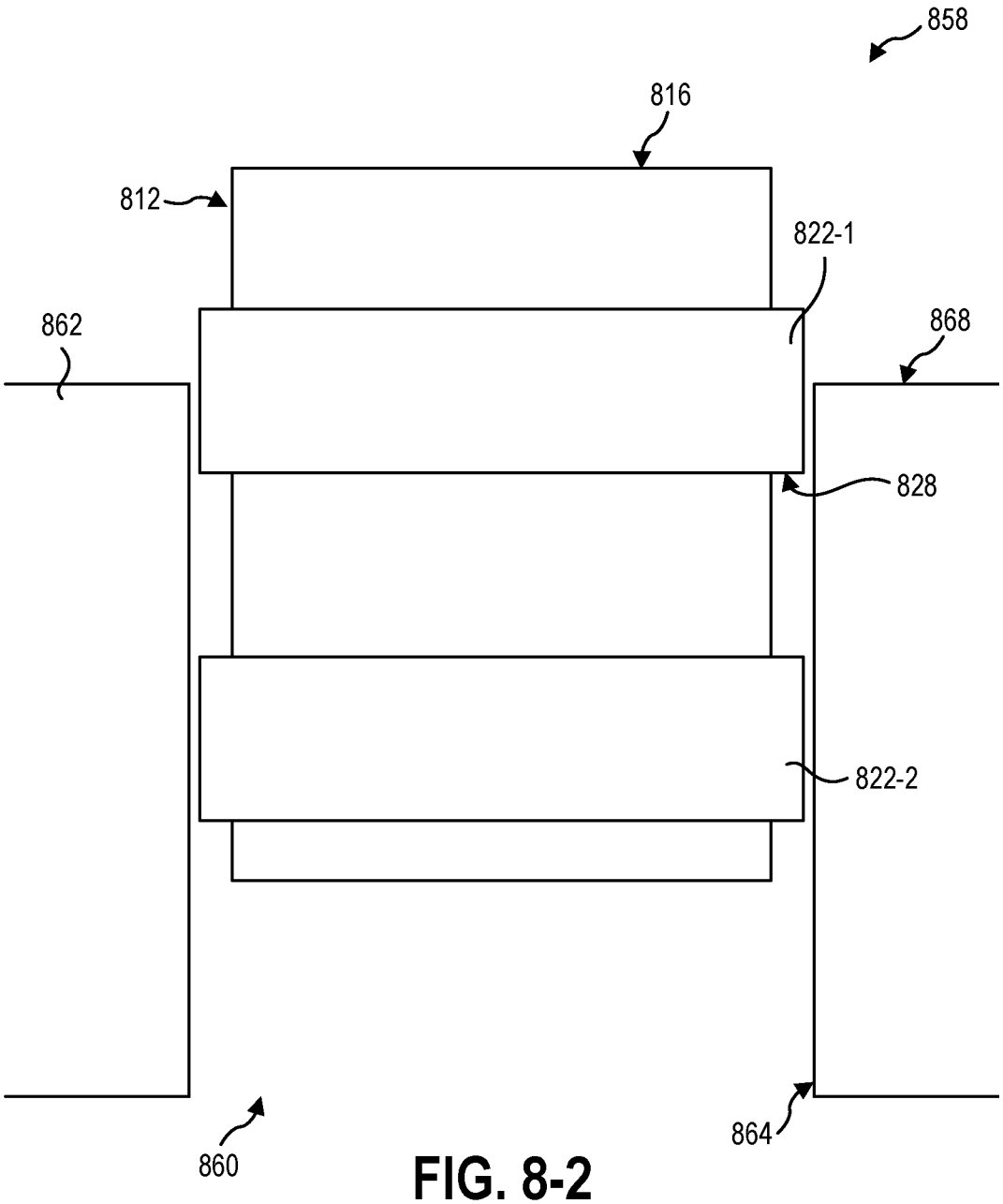

FIG. 8-1 is a representation of a piston assembly 858 in a retracted position, according to at least one embodiment of the present disclosure. In the retracted position shown, the piston assembly 858 includes a piston 812 inserted into the bore 860 of a housing 862. The piston 812 may include one or more sealing surfaces (collectively 822). The sealing surfaces 822 engage an inner surface 864 of the bore 860. In some embodiments, at least one of the sealing surfaces 822 may form a tolerance seal with the inner surface 864 of the bore 860. The tolerance seal between the sealing surfaces 822 and the inner surface 864 may be formed via a gap 866 between the outer diameter of the sealing surface (e.g., the sealing surface diameter 240 of FIG. 2) and the inner diameter of the bore 860. In some embodiments, the gap 866 may be small enough that debris and/or fluid may not pass between the sealing surface 822 and the inner surface 864. For example, the gap 866 may be less than 1 mm, less than 0.5 mm, less than 0.1 mm, less than 0.05 mm, less than 0.04 mm, less than 0.03 mm, or less than 0.02 mm. In some embodiments, a seal formed by the gap 866 may not require any additional sealing element, such as an O-ring or other sealing element. This may increase the simplicity of the piston assembly 858.

The extend the piston 812, a force, such as fluid pressure, may be applied to the second end 818 of the piston 812. This may cause the first end 816 of the piston 812 to extend out of the housing 862 to the extended position shown in FIG. 8-2. In the extended position of the piston assembly 858 shown in FIG. 8-2, the first end 816 may be extended past an outer surface 868 of the housing 862. In some embodiments, in the extended position the first sealing surface 822-1 may remain in the bore 860. Thus, at least a portion of the first sealing surface 822-1 may remain in contact with the inner surface 864 in the extended position. Accordingly, the inner edge 828 of the first sealing surface 822-1 may remain in the bore 860 (e.g., closer to a longitudinal axis of the downhole tool than the outer surface 868 of the housing 862). In some embodiments, the first sealing surface 822-1 may not engage the inner surface 864 in the extended position.

In some embodiments, the second sealing surface 822-2 may remain in the housing 862 in the extended position. In this manner, the second sealing surface 822-2 may stabilize the piston 812 in the housing 862. This may help the piston 812 maintain its orientation, and prevent binding, catching, tilting, or other non-desirable movement from the piston 812. In some embodiments, in the extended position, both the first sealing surface 822-1 and the second sealing surface 822-2 may remain in the bore 860 of the housing 862.

To retract the position from the extended position shown in FIG. 8-2 to the retracted position shown in FIG. 8-1, the fluid pressure pushing against the piston 812 may be reduced, and the force from the wellbore wall pushing against the first end 816 of the piston 812 may push the piston 812 back into the housing. A single extension and retraction of the piston 812 may be considered a cycle.

While cycling of the piston 812, the sealing surface 822 may contact the inner surface 864 of the bore 860. Repeated cycling may cause one or both of the sealing surface 822 and the inner surface 864 to experience wear. In some embodiments, the inner surface 864 may include a hard material, such as sintered tungsten carbide. As discussed above, the sealing surface 822 may be formed from a hard material, deposited by laser cladding. Because the sealing surface 822 and the inner surface 864 are both formed from hard materials, the piston assembly 858 may be wear resistant. For example, the piston assembly 858 may be able to experience 100,000 cycles, 200,000 cycles, 300,000 cycles, 400,000 cycles, 500,000 cycles, 600,000 cycles, 700,000 cycles, 800,000 cycles, 900,000 cycles, 1,000,000 cycles, or more cycles, without experiencing a reduction in diameter (e.g., mass) of the sealing surface 822 and/or the inner surface 864.

In some embodiments, at least a portion of the inner surface 864 may have laser cladding applied to it. In this manner, the inner surface 864 and the sealing surface 822 may both be formed same process and may include the same material. This may further help to reduce wear on the sealing surface 822 and/or the inner surface 864.

Figure 9:
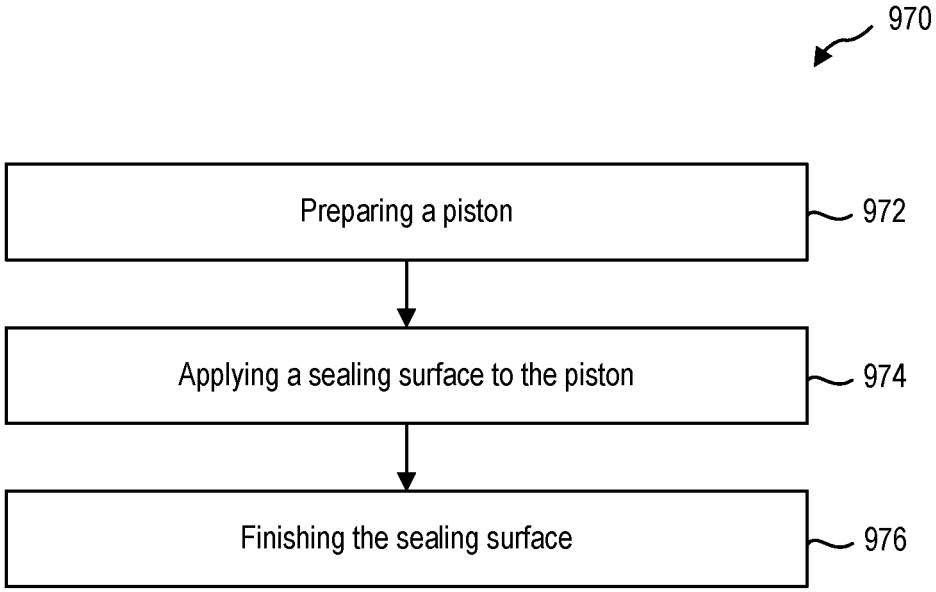
FIG. 9 is a representation of a method for manufacturing a piston, according to at least one embodiment of the present disclosure.

FIG. 9 is a representation of a method 970 for manufacturing a piston, according to at least one embodiment of the present disclosure. The method 970 may include preparing a piston at 972. In some embodiments, preparing the piston may include forming the piston. In some embodiments, the piston may be formed by placing matrix material (such as tungsten carbide powder). A binder material (e.g., an infiltrant) may be melted and allowed to flow into the matrix material. Preparing the piston may further include preparing the surface of the circumferential wall of the body of the piston. For example, the circumferential wall may be machined or ground to a prepared diameter.

The method 970 may further include applying a sealing surface to the piston at 974. The sealing surface may be applied to the piston by laser cladding. Laser cladding may include applying a sealing surface material to the circumferential wall of the body. A laser may partially or fully melt the sealing surface material and/or the circumferential wall of the piston, and the particles may bond to each other and the circumferential wall. The sealing surface material may be harder than the matrix material bound by the binder of the piston body. In some embodiments, applying the sealing surface may include applying the sealing surface in a plurality of longitudinally adjacent layers.

The method 970 may further include finishing the sealing surface to a sealing surface diameter at 976. In some embodiments, finishing the sealing surface may include finishing the sealing surface to a sealing surface diameter tolerance of 0.02 mm. In some embodiments, the sealing surface diameter tolerance may be in a range having a lower value, an upper value, or lower and upper values including any of 0.1 mm, 0.09 mm, 0.08 mm, 0.07 mm, 0.06 mm, 0.05 mm, 0.04 mm, 0.03 mm, 0.02 mm, 0.01 mm, or any value therebetween. For example, the sealing surface diameter tolerance may be greater than 0.01 mm. In another example, the sealing surface diameter tolerance may be less than 0.1 mm. In yet other examples, the sealing surface diameter tolerance may be any value in a range between 0.1 mm and 0.01 mm. In some embodiments, it may be critical that the sealing surface diameter tolerance is less than or equal to 0.02 mm to enable the sealing surface to seal against the inner surface of the housing.

In some embodiments, the method may include using laser cladding to apply other hard or wear surfaces. For example, laser cladding may be used to apply a wear surface to a contact end of the piston. This may help to extend the life of the piston.

The embodiments of the downhole piston have been primarily described with reference to wellbore drilling operations; the downhole pistons described herein may be used in applications other than the drilling of a wellbore. In other embodiments, downhole pistons according to the present disclosure may be used outside a wellbore or other downhole environment used for the exploration or production of natural resources. For instance, downhole pistons of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. Changes that come within the meaning and range of equivalency of the claims are to be embraced within their scope.

What is claimed is:

1. A piston for use in a downhole tool, comprising:

a body formed of a first material, the body including a first end, a second end, and a circumferential wall;

a radially outwardly facing, circumferential sealing surface formed by laser cladding a second material to the body extending around the circumferential wall, the second material being harder than the first material, the circumferential sealing surface having a sealing surface diameter, the sealing surface diameter having a tolerance of less than or equal to 0.02 mm; and a housing including a housing bore and an inner surface, the body being positioned at least partially in the housing bore and the circumferential sealing surface of the second material forming a tolerance seal between the inner surface and the circumferential sealing surface.

2. The piston of claim 1, wherein the first material comprises an infiltrated tungsten carbide matrix and the second material is different than the first material.

3. The piston of claim 2, wherein the infiltrated tungsten carbide matrix comprises a plurality of tungsten carbide particles and the second material is bonded to the plurality of tungsten carbide particles.

4. The piston of claim 2, wherein the second material is different from the first material in at least one of chemical composition, particle size, particle hardness, particle density, particle shape, or particle size ratio.

5. The piston of claim 1, wherein the second material is a tungsten carbide material having a hardness that is greater than 40 HRC.

6. The piston of claim 1, wherein the circumferential sealing surface includes a plurality of layers of the second material, the plurality of layers being longitudinally adjacent to and adhered to one another.

7. The piston of claim 1, wherein the body has a body diameter, and the sealing surface diameter is larger than the body diameter.

8. The piston of claim 1, wherein the first end includes a contact surface and the contact surface includes the second material.

9. A downhole piston assembly, comprising:

a piston, the piston including:

a body including a first end, a second end, a circumferential wall, and an extension axis, the body having a first diameter and including a first material; and a sealing surface formed by laser cladding extending around the circumferential wall, the sealing surface being perpendicular to the extension axis, the sealing surface being a radially outwardly facing circumferential surface having a second diameter greater than the first diameter, the sealing surface having an outer edge at an outer edge distance relative to the first end of the body and having an inner edge distance relative to the second end of the body, the outer edge distance being between 10% and 50% of a length of the piston and the inner edge distance being less than 30% and greater than 0% of the length of the piston, the sealing surface including a second material, the second material being harder than the first material; and a housing including a housing bore and an inner surface, the piston being longitudinally movable in the housing bore along the extension axis, the sealing surface forming a tolerance seal between the inner surface of the housing and the sealing surface of the second material.

10. The downhole piston assembly of claim 9, wherein the inner surface is formed from sintered tungsten carbide.

11. The downhole piston assembly of claim 9, wherein the sealing surface is a first sealing surface and further comprising a second sealing surface offset from the first sealing surface.

12. The downhole piston assembly of claim 11, the body including a piston bore transverse to the extension axis of the body, the second sealing surface being located between the piston bore and the second end.

13. The downhole piston assembly of claim 12, the housing including a pin extending at least partially into the piston bore.

14. The downhole piston assembly of claim 9, the sealing surface including at least first and second longitudinally offset sealing surfaces, with the first sealing surface being nearest the first end of the body and the second sealing surface nearest the second end of the body, the second end being radially inward relative to the first end along the extension axis, wherein the body further includes:

a piston bore transverse to the extension axis, the piston bore having a first end and a second end, the first end being longitudinally aligned with the first sealing surface, and the second end being offset from, and longitudinally outward relative to, the second sealing surface; and a pin extending into the piston bore and which limits over extension of the piston.

15. A method for manufacturing a piston, comprising:

preparing a piston, the piston including a first end, the piston having a body of a prepared diameter and being formed from a first material;

applying a sealing surface to the piston using laser cladding, the sealing surface including a radially outwardly facing circumferential surface of a second material harder than the first material;

finishing the sealing surface to a sealing surface diameter greater than the prepared diameter, the sealing surface diameter having tolerances of less than or equal to 0.02 mm; and placing the piston in a housing bore of a housing, the housing including an inner surface forming a tolerance seal with the second material of the radially outwardly facing circumferential surface.

16. The method of claim 15, further comprising applying a wear surface to the first end of the piston via laser cladding.

17. The method of claim 15, wherein preparing the piston includes forming the piston in a mold and grinding a circumferential wall of the piston to the prepared diameter.

18. The method of claim 15, wherein applying the sealing surface includes applying a plurality of layers of the second material to the piston, with the plurality of layers being adjacent and adhering to one another.

* * * * *